United States Patent [19]

Ishino et al.

[11] Patent Number: 4,525,614

[45] Date of Patent: Jun. 25, 1985

[54] ABSORBER DEVICE FOR MICROWAVE LEAKAGE

[75] Inventors: Ken Ishino; Yasuo Hashimoto, both of Tokyo, Japan

[73] Assignee: TDK Corporation, Tokyo, Japan

[21] Appl. No.: 438,256

[22] Filed: Nov. 1, 1982

[30] Foreign Application Priority Data

| | | | |
|---|---|---|---|
| May 28, 1982 | [JP] | Japan | 57-89873 |
| May 31, 1982 | [JP] | Japan | 57-79007[U] |
| May 31, 1982 | [JP] | Japan | 57-79008[U] |
| May 31, 1982 | [JP] | Japan | 57-79009[U] |
| May 31, 1982 | [JP] | Japan | 57-79010[U] |

[51] Int. Cl.[3] ..... H05B 6/76

[52] U.S. Cl. ..... 219/10.55 D; 219/10.55 R; 174/35 GC; 174/35 MS

[58] Field of Search ..... 219/10.55 D, 10.55 R; 174/35 GC, 35 MS; 333/12, 204

[56] References Cited

U.S. PATENT DOCUMENTS

| | | | |
|---|---|---|---|
| 3,678,238 | 7/1972 | Yasuoka et al. | 219/10.55 D |
| 3,866,009 | 2/1975 | Ishino et al. | 219/10.55 D |
| 3,985,993 | 10/1976 | Imberg et al. | 219/10.55 D |
| 4,046,983 | 9/1977 | Ishino et al. | 219/10.55 D |
| 4,081,647 | 3/1978 | Torrey | 219/10.55 D |
| 4,166,207 | 8/1979 | Burke | 219/10.55 D |
| 4,332,992 | 6/1982 | Larsen et al. | 219/10.55 R |

FOREIGN PATENT DOCUMENTS

| | | | |
|---|---|---|---|
| 2083329 | 3/1982 | United Kingdom | 219/10.55 D |

*Primary Examiner*—Philip H. Leung

*Attorney, Agent, or Firm*—Martin M. Novack

[57] ABSTRACT

A microwave absorber device for a microwave heater having a main body with an opening and a door for closing said opening with a leakage path between the door and the main body. The absorber device has a choke cavity along a leakage path of the microwave energy between the main body and the door, said choke cavity having an approximate $\frac{1}{4}$ wavelength of length, and an entrance facing said leakage path for accepting microwave energy. Said entrance of the choke cavity is closed by a cover plate made of ferro-magnetic material, which is a mixture of ferrite and gum. Preferably, an additional microwave absorber made of ferro-magnetic material which is integral with said cover plate is provided next to the choke cavity. Preferably, the dielectric constant of the material of the cover plate is less than 15. Still, preferably, the ratio of the imaginary part of the complex permeability to the real part of the same of the cover plate material is larger than 0.5.

21 Claims, 26 Drawing Figures

A
B
1
2
3
4
5
6
7
40MHz
0
10
20
30
40
2250
2450
2650
ATTENUATION (dB)
FREQUENCY (MHz)

ABSORBER DEVICE FOR MICROWAVE LEAKAGE

BACKGROUND OF THE INVENTION

The present invention relates to the improvement of an electro-magnetic wave absorber device, or the improvement of a device for preventing the leakage of waves. The present device is used, for instance, for preventing leakage of wave energy in a micro-wave heater, like a micro-wave oven.

Conventionally, an absorber device for microwave leakage in a microwave oven has three absorber means. The first one is a metal contact spring which provides the conductive contact between the body and the door to close the door completely. The second one is a choke cavity with $\frac{1}{4}$ wavelength for absorbing waves which leak through said conductive contact. The third one is a ferrite absorber provided at the outlet of the leakage path for absorbing the rest of the leakage.

The present invention relates, in particular, to the improvement of said choke cavity, and/or the combination of the choke cavity and the ferrite absorber.

FIG. 1 shows the structure of a prior wave absorber device which has said three absorber means. In the figure, the reference numeral 1 is a wall of the main body of a microwave heater, 2 is a door for closing the opening of the main body, 3 is a cabin of the main body. The elongated thin leakage path L is left between the wall 1 of the main body and the door 2. Along the leakage path L, the conductive spring 13 which provides the complete electrical contact between the wall 1 and the door 2, the choke cavity 6 provided in the door 2, and the ferrite absorber means 7 are provided. The microwave energy which tends to leak is first prevented by the spring 13, then, some portion which leaks past the spring 13 is absorbed by the choke cavity 6, and then, the rest of the microwave energy which still leaks past the choke cavity 6 is absorbed by the ferrite absorber 7 as shown by the dotted line in the figure. The choke cavity 6 has conductive walls 4 and 5 which provide an elongated closed body with the length of $\frac{1}{4}$ wavelength. The choke cavity 6 has a window for entering waves, and said window is covered by the choke cover 8 which is made of dielectric material like polypropylene which has a small dielectric constant in order to prevent dust entering into the choke cavity 6. The reference numeral 9 is a decorative cover made of plastic, 10 is a glass window provided on the door 2, 11 is a conductive net which provides the shield effect to the glass window 10, 12 is a fixing screw, and 13 is a conductive spring for providing the conductive contact between the door 2 and the main body wall 1.

As mentioned above, waves which tend to leak are first prevented by the conductive spring 13, then, waves which leak past the spring 13 are absorbed by the choke cavity 6. The choke cavity 6 receives waves through the entrance window 6*a* which is covered by the dielectric body 8 which does not prevent the entrance of waves into the choke cavity 6. The waves which still leak past the choke cavity 6 are finally absorbed by the ferrite absorber 7 which is positioned next to the choke cavity 6.

However, a prior absorber device as in FIG. 1 has disadvantages as follows. First, the bandwidth of the choke cavity 6 for providing enough attenuation is rather norrow, and therefore, the size of the choke cavity for absorbing microwaves of 2450 MHz must be very accurate. If the center frequency of the choke cavity 6 for providing the maximum attenuation shifts a little from 2450 MHz, the attenuation provided by the choke cavity 6 is deteriorated considerably. Secondly, a prior choke cavity can not provide enough attenuation because of a lot of operational modes of waves in a microwave oven. Although a prior choke cavity may provide enough attenuation in an experimental device which provides a single and pure operational mode of microwave power, it cannot provide enough attenuation in an actual microwave oven which has many operational modes. Further, since the material of the ferrite absorber 7 is different from the material of the choke cover 8, the structure of the combination of the choke cavity and the ferrite absorber is complicated. In order to solve some of said disadvantages, an improved choke cavity which has wave absorber material within the cavity itself has been proposed. Although that choke cavity has a large enough bandwidth, it has the disadvantages that the attenuation of the choke cavity is deteriorated considerably due to the decrease of the value Q of the choke cavity because of the presence of the absorber material within the cavity itself, and that absorber material in the cavity might be burnt or broken because of the strong magnetic and/or electric field in the cavity.

SUMMARY OF THE INVENTION

It is an object, therefore, of the present invention to overcome the disadvantages and limitations of prior microwave absorber devices.

It is also an object of the present invention to provide a microwave absorber device which has simple structure and provides enough attenuation with a relatively wide frequency band.

The above and other objects are attained by a microwave absorber device comprising a main body with an opening, a door for closing said opening, a choke cavity provided along a leakage path between the main body and the door, said choke cavity having the length approximately $\frac{1}{4}$ wavelength and an entrance facing to said leakage path, said entrance of the choke cavity being closed by a cover means of a mixture of ferromagnetic material and dielectric material, the dielectric constant of the cover means being less than 15. Preferably, the ratio of the imaginary part of complex permeability of cover means to the real part of the same is larger than 0.5.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

The principle concept or one of the important features of the present invention is the structure of a cover means which occurs an entrance of a choke cavity. The present cover means is made of ferro-magnetic material, like ferrite, and the cover means doubles as a microwave absorber.

First, the experimental equipment and the experimental result of the present invention are explained for initial understanding of the present invention.

Figure 2:
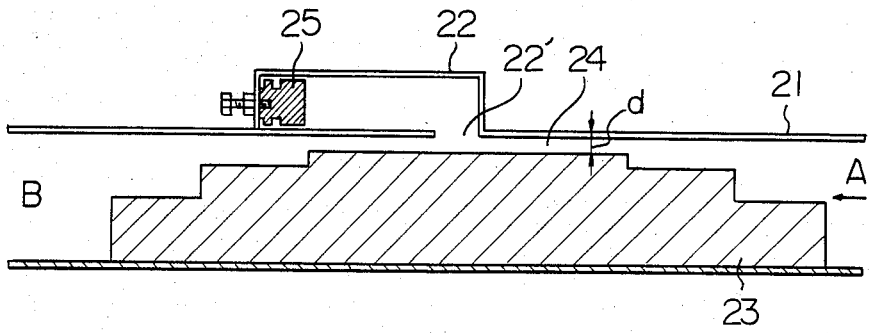
FIG. 2 shows the structure of the experimental device.

FIG. 2 shows the cross section of the measurement device in which the reference numeral 21 is a waveguide having an opening on the ceiling wall of the same, 22 is a choke cavity with the length of $\frac{1}{4}$ wavelength, and 23 is a step converter which simulates the narrow path between an oven body and a door of a microwave oven. The step converter 23 has some steps as shown in the figure in order to prevent reflection of microwave energy. In the figure, the symbol (*d*) shows the width of the gap of the leakage path 24, and 22' is an entrance of the choke cavity 22. The adjustable short-circuit conductor 25 is provided at the end of the choke cavity 22 in order to adjust the length of the choke cavity 22.

Figure 3:
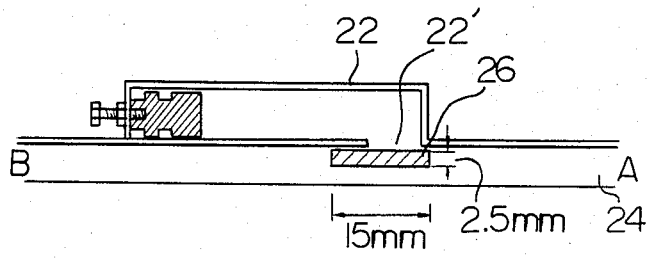
FIG. 3 shows also the experimental device which has the cover means 26 for covering the entrance of the choke cavity.

FIG. 3 shows a cover member 26 which closes the entrance 22' of the choke cavity 22, and said cover member 26 is positioned in the leakage path 24. The cover member 26 is a flat member (the thickness is 2.5 mm, and the length is 15 mm in the experiment), and the material of that cover member 26 is changed in the experiment. The cover member 26 closes the entrance 22', and extends a little in the leakage direction as shown in FIG. 3 so that said cover member 26 doubles as a wave absorber.

Seven samples of the cover member 26 were tested, and the components of each sample are shown in the table 1.

TABLE 1

| Ferrite material | Mixture ratio gum: ferrite | Sample No. | $\mu'$ | $\mu''$ | tan $\delta_\mu$ ($\mu''/\mu'$) | $\epsilon'$ | $\epsilon''$ | $\alpha$ (dB/cm) |
|---|---|---|---|---|---|---|---|---|
| Ni Mg Zn group | 1:1 | 1 | 1.14 | 0.55 | 0.48 | 4.5 | 0.1 | 2.37 |
| | 1:3 | 2 | 1.09 | 1.39 | 1.28 | 6.6 | 0.2 | 6.66 |

TABLE 1-continued

| Ferrite material | Mixture ratio gum: ferrite | Sample No. | $\mu'$ | $\mu''$ | tan $\delta_\mu$ ($\mu''/\mu'$) | $\epsilon'$ | $\epsilon''$ | $\alpha$ (dB/cm) |
|---|---|---|---|---|---|---|---|---|
| ferrite | 1:5 | 3 | 1.02 | 1.83 | 1.79 | 8.3 | 0.2 | 9.42 |
| Mn-Zn | 1:2 | 4 | 1.65 | 1.16 | 0.7 | 14.5 | 1.5 | 7.27 |
| group | 1:3 | 5 | 1.77 | 1.90 | 1.07 | 22.4 | 2.7 | 13.6 |
| ferrite | 1:4 | 6 | 1.80 | 2.07 | 1.15 | 30.5 | 3.3 | 17.0 |
| | 1:5 | 7 | 1.82 | 2.33 | 1.28 | 41.4 | 5.7 | 21.6 |

In the table 1, the samples 1, 2 and 3 are gum-ferrite which is the mixture of Ni-Mg-Zn group ferrite powder and chloroprene gum, and has a relatively small dielectric constant and a large magnetic loss. The samples 4, 5, 6 and 7 are gum-ferrite which is the mixture of Mn-Zn group ferrite powder and chloroprene gum, and has a relatively large dielectric constant and a large magnetic loss.

Figure 1:
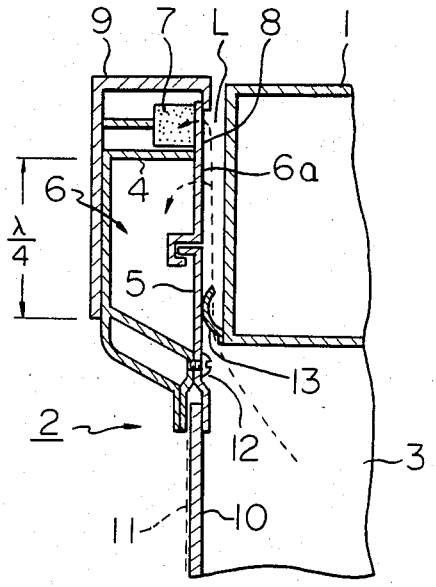
Fig. 1 Prior Art
FIG. 1 shows a prior wave absorber device.

Each sample (No. 1 through No. 7 in the table 1) covers the entrance 22' in FIG. 1 or FIG. 2, and a microwave generator (not shown) which provides the output frequency 2200 MHz–2660 MHz is coupled with the input of the waveguide 21 (right end A of FIG. 1 or FIG. 2) of the waveguide 21. The output power at the left end B of the waveguide 21 is indicated on a screen of an oscilloscope after logarithm convertion of the level. The characteristics of each sample of cover members are evaluated through the level and the waveform on the screen.

Figure 4:
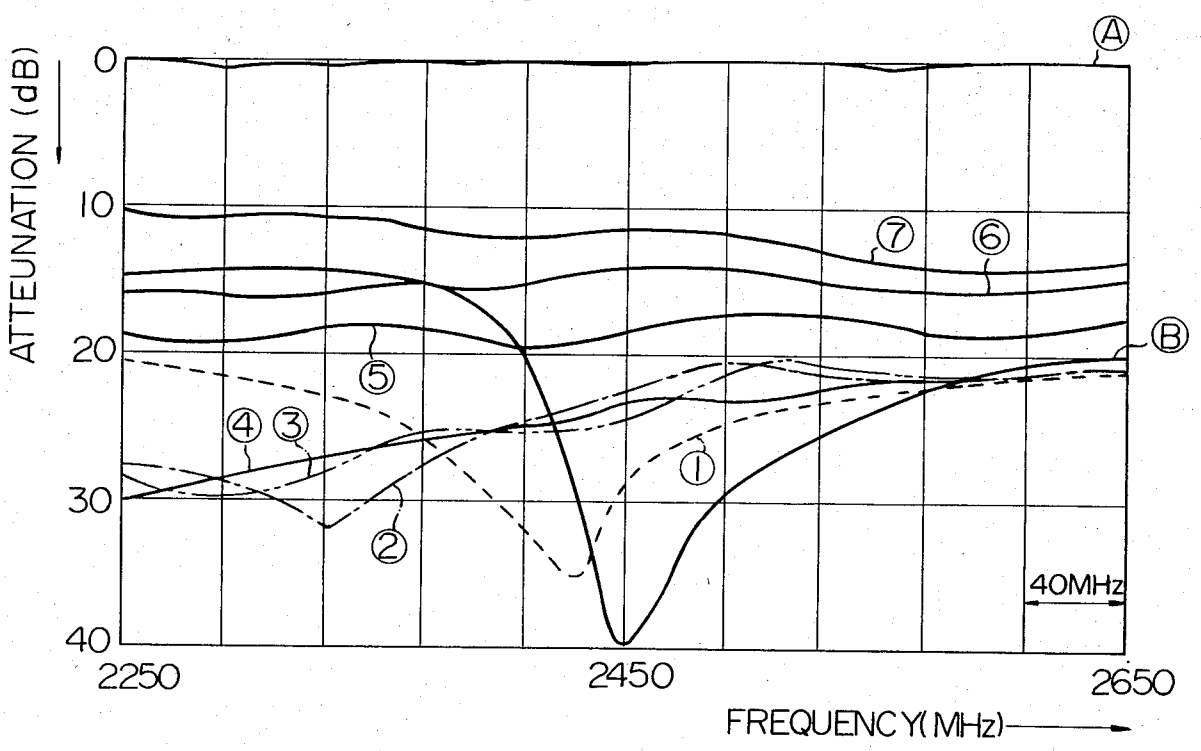
FIG. 4 shows the curves of the attenuation characteristics according to the present invention.

FIG. 4 shows the curves of the experiments, in which the horizontal axis shows the frequency, and the vertical axis shows the attenuation in dB. In FIG. 4, the curve A shows the characteristics when the entrance 22' is covered with a conductive plate, and that is equivalent to the case when no choke cavity is provided. The curve B shows the characteristics when the entrance 22' is open, or the entrance 22' is not covered by a sample of the table 1. The curves 1 through 7 show the characteristics when the entrance 22' is covered with the samples 1 through 7, respectively (the length and the width of each sample is 15 mm, and 2.5 mm). It should be appreciated that the samples No. 1 through No. 7 have a dielectric constant ($\epsilon'$) in the range between 4.5 and 41.4 as shown in the table 1.

When there is no choke cavity provided, or the entrance 22' is closed by the conductive member, the attenuation is almost flat as shown by the curve A in FIG. 4. That curve A is the reference level of 0 dB in the present experiment.

When the entrance 22' is not covered, the choke cavity operates completely, and the attenuation of 40 dB is obtained at the center frequency of 2450 MHz, which is the resonant frequency of the choke cavity. It should be noted that only 1/10,000 of the power leaks (40 dB of attenuation) at the center frequency 2450 MHz.

The curves No. 1 through 7 in which the entrance 22' of the choke cavity is closed by the cover members No. 1 through 7 of the table 1, respectively, show as follows. The samples No. 1 through No. 4, which have the dielectric constant ($\epsilon'$) less than 15 provide a peak attenuation, and wider frequency characteristics than the case where no cover means is used. In those cases (No. 1 through No. 4), the maximum attenuation is a little smaller than that of the curve B, and the frequency which gives the maximum attenuation shifts a little in the lower frequency direction as compared with the center frequency of the curve B.

It should be appreciated that the attenuation for a microwave oven must be higher than 20 dB, but it does not need to reach 40 dB. Therefore, when the attenuation higher than 20 dB is obtained, it is preferable to provide the wider frequency bandwidth in which the attenuation exceeds 20 dB, than to obtain the higher maximum attenuation close to 40 dB at the center frequency (2450 MHz) in conjunction with narrow bandwidth.

Now, returning to FIG. 4, the curves No. 5 through No. 7 in which the dielectric constant is relatively large and is larger than 20 show that the frequency characteristics are almost flat without a peak value. In particular, the sample No. 7 (the dielectric constant is 41.4) shows that the characteristics are flat without the effect of the choke cavity. Therefore, it should be appreciated that when the dielectric constant of the cover means is large, the reflection by the cover means itself is large, and the electro-magnetic wave does not enter into the choke cavity, and therefore, the choke cavity does not affect the characteristics. The curves (5), (6) and (7) can not provide attenuation higher than 20 dB.

Although the center frequency which gives the maximum attenuation shifts in the lower frequency direction in FIG. 4, the frequency which gives the maximum attenuation can be adjusted to 2450 MHz if the length of the choke cavity is adjusted by the adjustable short-circuit conductor 25.

Figure 5:
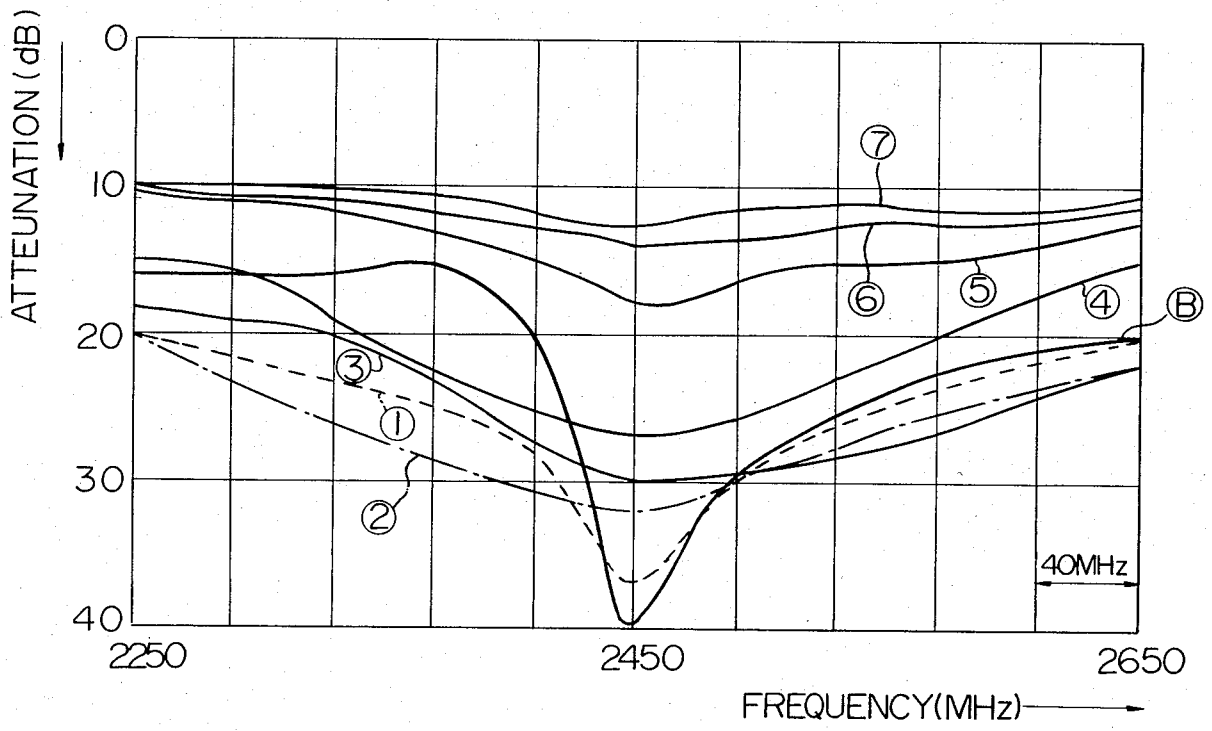
FIG. 5 shows also the curves of the attenuation characteristics according to the present invention.

FIG. 5 shows the frequency characteristics in which the length of the choke cavity is shortened by 0.5–10 mm by adjusting the short-circuit conductor 25. In FIG. 5, the horizontal axis shows the frequency in MHz, the vertical axis shows the attenuation in dB, and the curves B, 1 through 7 correspond to the curves B and 1 through 7 of FIG. 4. As apparent from FIG. 5, when the dielectric constant ($\epsilon'$) is less than 15 (the samples 1 through 4), the choke cavity operates satisfactory, and the frequency band is wider than the case when no cover means is used. When the dielectric constant is larger than 20 (the samples 5 through 7), the reflection by the cover means is large, and the wave does not enter into the choke cavity, thus, the choke cavity does not perform satisfactory.

As apparent from the above experimentation, the dielectric constant greatly affects the attenuation, and/or the frequency band.

The table 2 shows the relationship of the maximum attenuation (dB), the bandwidth which provides the attenuation higher than 20 dB, and the transmission attenuation by the material itself of the cover means (dB/cm) for each sample (No. 1 through No. 7).

TABLE 2

| Sample No. | $\epsilon'$ | Maximum attenuation (dB) | Bandwidth (MHz) with attenuation higher than 20 dB | Transmission attenuation of material itself |
|---|---|---|---|---|
| 1 | 4.5 | 37 | 400 | 2.37 |
| 2 | 6.6 | 32 | 400 | 6.7 |
| 3 | 8.3 | 30 | 300 | 9.4 |
| 4 | 14.5 | 27 | 240 | 7.27 |
| 5 | 22.5 | 18 | — | 13.6 |
| 6 | 30.5 | 14 | — | 17.0 |
| 7 | 41.4 | 13 | — | 21.6 |
| no magnetic cover | — | 40 | 220 | — |

TABLE 2-continued

| Sample No. | $\epsilon'$ | Maximum attenuation (dB) | Bandwidth (MHz) with attenuation higher than 20 dB | Transmission attenuation of material itself |
|---|---|---|---|---|
| means | | | | |

Figure 6:
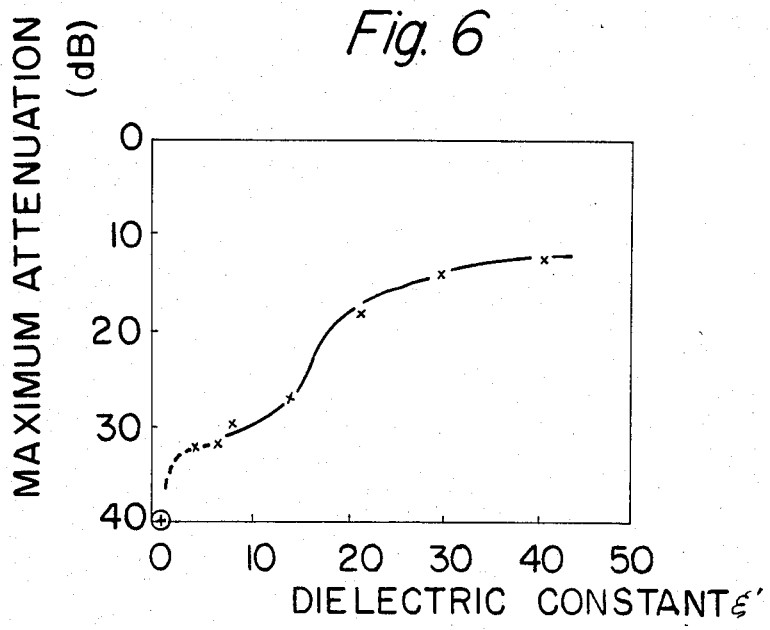
FIG. 6 and FIG. 7 show curves of the attenuation and the bandwidth for the change of the dielectric constant according to the present invention, FIGS. 8(*a*), 8(*b*) and 8(*c*) show some examples of the structure of a cover means.
Figure 7:
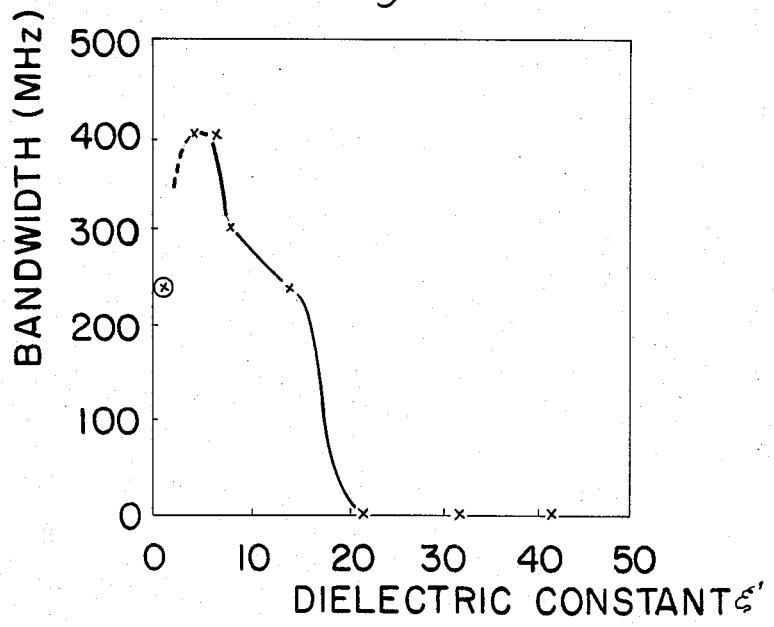

Further, the relationship between the dielectric constant (horizontal axis) and the maximum attenuation is shown in FIG. 6, and the relationship between the dielectric constant (horizontal axis) and the bandwidth (vertical axis) is shown in FIG. 7. Those FIGS. 6 and 7 are derived from FIG. 5 or FIG. 4.

It should be appreciated in FIGS. 6 and 7 that when the dielectric constant is less than 15, the maximum attenuation is higher than 25 dB which is enough for the wave absorber device in a microwave oven, and the frequency band is wider than 240 MHz which is also sufficient in a microwave oven. When the dielectric constant is larger than 15, the characteristics deteriorate rapidly as shown in FIGS. 6 and 7.

It should be appreciated further that the cover means itself has the nature to attenuate electro-magnetic energy. The samples No. 1 through No. 7 have the transmission attenuation ($\alpha$) higher than 2 dB/cm, and provide some attenuation. Even when the length ($d$) in FIG. 2 is long, and the choke cavity does not provide enough attenuation, the cover means itself can provide some attenuation.

It should be appreciated that the transmission loss ($\alpha$) depends considerably upon the value of tan $\delta\mu$ of material. For instance, the samples No. 3, and No. 4 in the table 1, have tan $\delta\mu=1.79$ and tan $\delta\mu=0.70$, respectively, and the transmission loss is 9.42 dB/cm, and 7.27 dB/cm, respectively. Further, the sample No. 1 in the table 1 has the tan $\delta\mu=0.48$, and the transmission attenuation $\alpha=2.37$ dB/cm. Therefore, it is preferable that the value of tan $\delta\mu$ is larger than 0.5 in order to provide the attenuation higher than 50% of power (3 dB).

Figure 8:
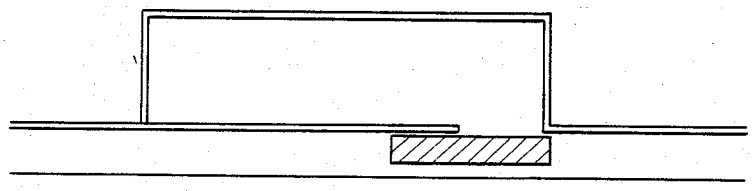
Figure 8:
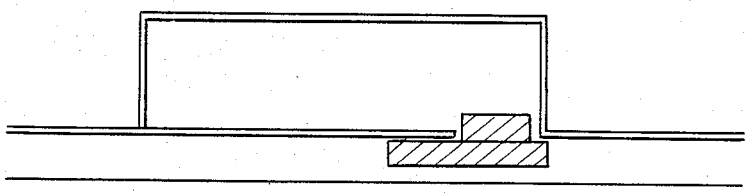
Figure 8:
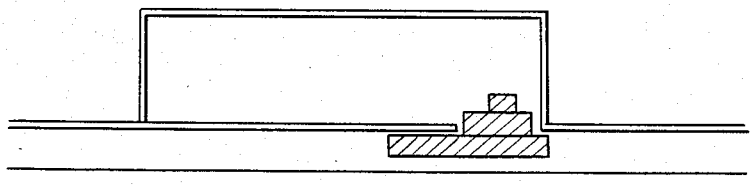

Further, it is preferable that the cover means is flat along the path of the wave, and has a short projection projected into the choke cavity as described later in accordance with FIGS. 8 and 9. That projection has the effect of an antenna to introduce energy into the choke cavity, and therefore, improves the attenuation characteristics.

Figure 9:
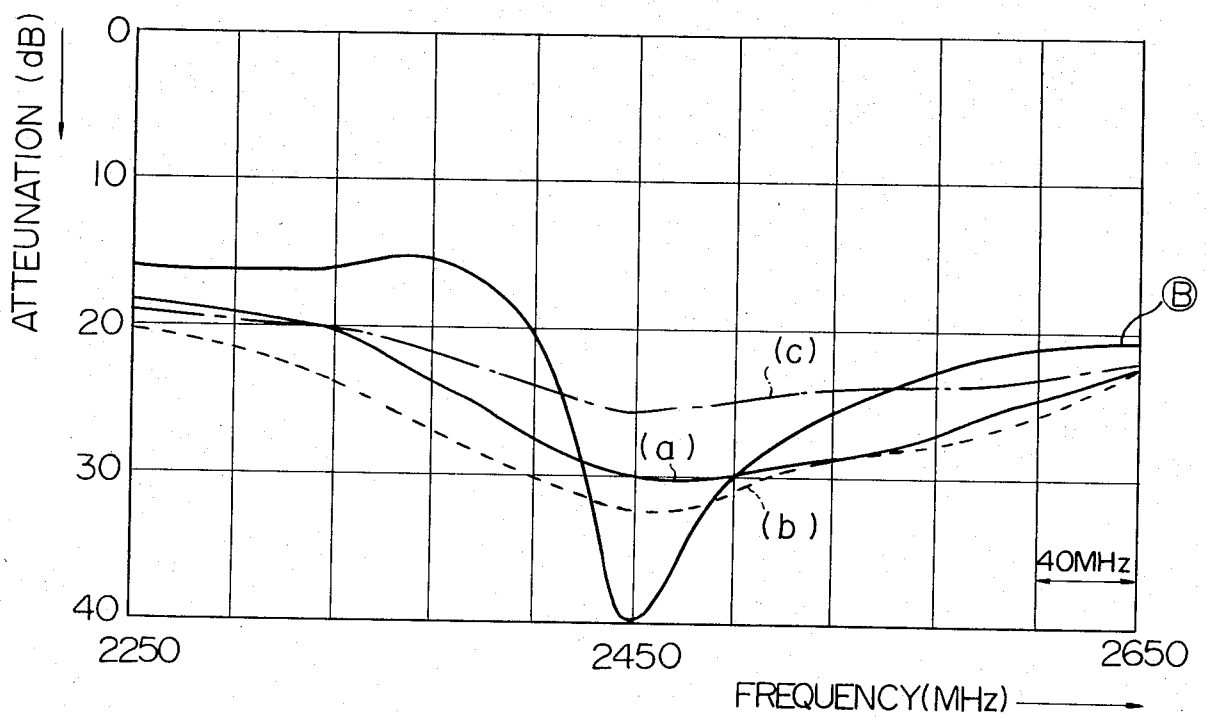
FIG. 9 shows curves of the attenuation characteristics for each structure of the cover means of FIGS. 8(*a*) through 8(*c*)

FIG. 9 shows the attenuation characteristics for each shape of cover means. In FIG. 9, the horizontal axis shows the frequency, the vertical axis shows the attenuation, and the sample material in the experiment of FIG. 9 is the sample No. 3 in the table 1. The curve B in FIG. 9 shows the case where no cover means is provided, the curves ($a$), ($b$), and ($c$) show the cases where the cover means of FIGS. 8($a$), 8($b$) and 8($c$) are used, respectively. FIG. 8($a$) shows the case where the cover means is just a flat plate, FIG. 8($b$) shows the case where the cover means has a step projected into the choke cavity, and the cover means in FIG. 8($c$) has two steps. The height of each step in the experiment is 2.5 mm. Among the curves (a), (b) and (c) of FIG. 9, the curve (b) is the most preferable in view of the attenuation at the center frequency (2450 MHz), and the bandwidth. The attenuation of the curve (c) is decreased because the cover means enters into the choke cavity too deeply. The too deep insertion of the cover means of ferro-magnetic material deteriorates the characteristics of the choke cavity because the cover means decreases the value Q of the choke cavity. Therefore, the height of the projection of the cover means must not be too high, and the preferable height of the same is approximately 2.5 mm for a microwave oven.

Now, some structural examples of the present invention are described.

Figure 10A:
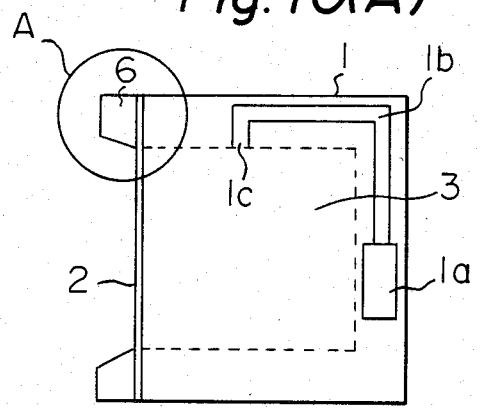
FIGS. 10A and 10B show the structure of the wave absorber according to the present invention.
Figure 10B:
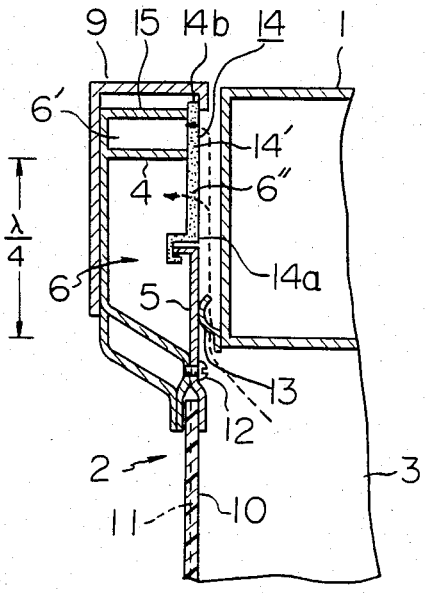

FIG. 10A shows a micro-wave heater, in which the reference numeral 1 is a wall of a housing body or a main body, 1*a* is a microwave generator with a magnetron tube which generates microwaves of 2450 MHz, 1*b* is a waveguide for applying microwave power generated by the generator 1*a* to a chamber of the oven, 2 is a door which closes the housing body 1, 3 is a chamber of the housing, and 6 is a wave absorber device or a choke cavity. The detailed structure of the portion A of FIG. 10A is shown in FIG. 10B. A narrow undesirable space is left between the door 2 and the wall 1 of the housing, and microwave energy leaks through that space.

In FIG. 10B, the door 2 has a choke cavity 6 along four sides of the rectangular door 2, and said choke cavity 6 faces the wall 1 of the body 1. The length of the choke cavity 6 is approximately $\frac{1}{4}$ wavelength. The conductive walls 4 and 5 enclose the choke cavity 6 but leave an opening or entrance 6″ of the cavity 6. That entrance 6″ is covered with a cover means of ferro-magnetic material as mentioned later. The reference numeral 9 is a decorative cover made of plastic, 10 is a transparent glass cover, 11 is a conductive net which has a shield effect and is inserted in the glass cover 10, 12 is a screw for fixing the choke cavity 6 to the door 2, and 13 is a conductive resilient spring fixed on the body 1 so that the door 2 contacts electrically to the body 1 in order to prevent the leakage of electro-magnetic energy. One end of the choke cavity 6 is slanted as shown in FIG. 10B in order to fit with the structure of the door 2. That slanted end of the choke cavity 6 is also effective in widing the bandwidth. The actual length of the choke cavity 6 is determined through experimentation with a cut-and-try procedure so that the center frequency of the choke cavity becomes 2450 MHz, and of course, the length of the choke cavity 6 is approximately $\frac{1}{4}$ wavelength.

In FIG. 10B, the reference numeral 14 is a cover means which covers the entrance opening 6″ of the choke cavity 6, and in the present embodiment, the material of the cover means 14 is the sample No. 3 in the previous table 1. One end of the cover means 14 has a hook 14*a* which engages with the end of the conductive wall 5, and the other end 14*b* extends beyond the choke cavity 6 and engages with the end of the decorative plastic cover 9. Accordingly, the cover means 14 is substantially parallel to the wall 1 and said cover means 14 closes the entrance of the choke cavity 6 and the additional next room 6′. That additional room 6′ mounts a ferrite absorber 7 in a prior art of FIG. 1. In the present embodiment of FIG. 10B, the extended portion 14′ of the cover means 14 for closing the room 6′ functions similar to the ferrite absorber 7 of the prior art of FIG. 1. Therefore, both the cover means of the choke cavity 6 and the ferrite absorber are provided by a single ferromagnetic material in the present invention.

In the above structure, the leakage of microwave power (the dotted line in FIG. 10B) is prevented by three means. First, the microwave power is prevented from leaking by the conductive spring contact 13 between the door 2 and the main body. Next, almost all the power which leaks past the conductive spring 13 is prevented by the choke cavity 6. Further, the rest of the power which still leaks past the choke cavity 6 is finally prevented from leaking by the extended portion 14′ of the cover means 14.

Figure 11A:
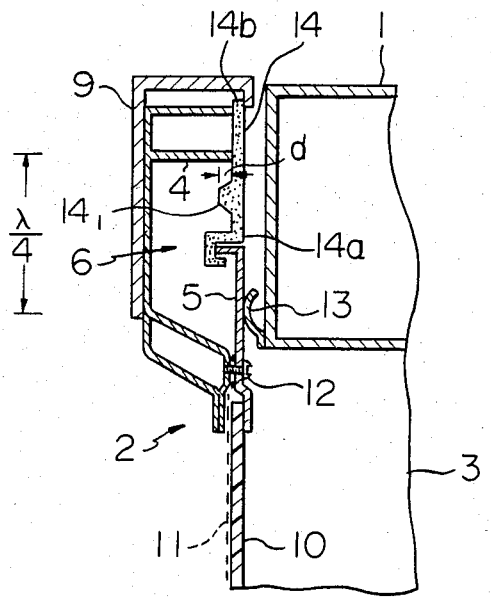
FIGS. 11A and 11B show the modification of the embodiment of FIGS. 10A and 10B, FIGS. 12A and 12B show another modification of the embodiment of FIGS. 10A and 10B, FIGS. 13A and 13B show still another modification of the embodiment of FIGS. 10A and 10B, FIGS. 14(*a*), 14(*b*), 14(*c*) and 14(*d*) show some alternatives of the structure of the wave absorber according to the present invention.
Figure 11B:
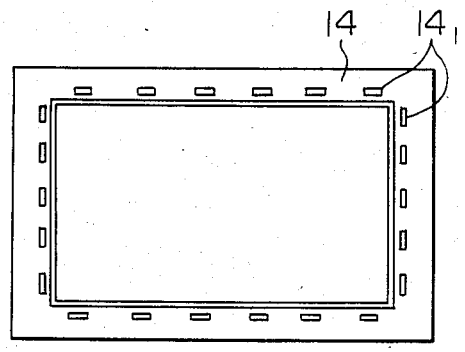

FIGS. 11A and 11B show the second structural embodiment according to the present invention. The feature of the embodiment of FIGS. 11A and 11B as compared with the previous embodiment of FIGS. 10A and 10B is the presence of the projection $14_1$ projected into the choke cavity 6 at the entrance of the same. A plurality of projections $14_1$ are provided with some intervals along the peripheral sides of the door 2 as shown in FIG. 11B. That projection $14_1$ operates as an antenna which introduces waves into the choke cavity, and therefore, the attenuation characteristics are improved as described before in accordance with FIGS. 8 and 9. Preferably, the height (d) of the projection $14_1$ is 2.5 mm.

Figure 12A:
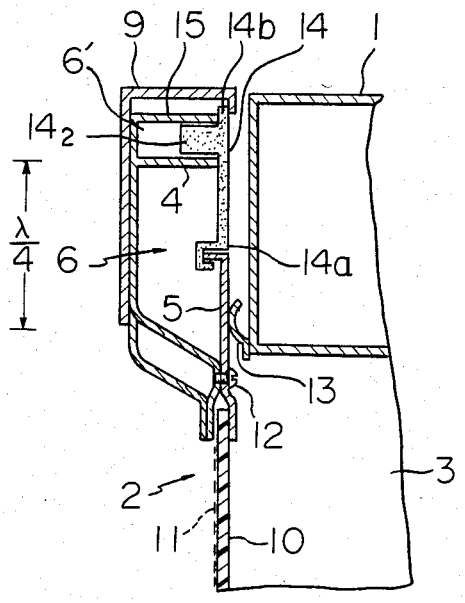
Figure 12B:
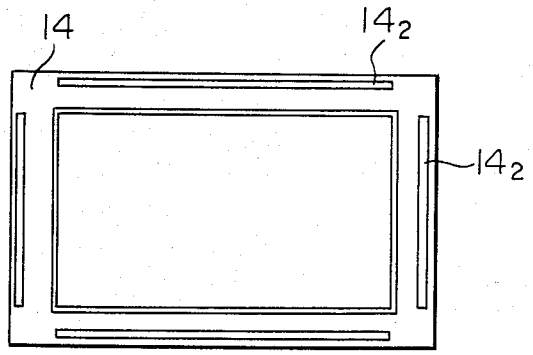

FIGS. 12A and 12B show a further modification of the embodiment of FIGS. 10A and 10B. The features of the embodiment of FIGS. 12A and 12B is the presence of the projection $14_2$ projected into the additional room 6′ defined by the conductive walls 4 and 15. That projection $14_2$ is integral with the cover means 14, and is of course made of the same material as that of the cover means 14. That projection $14_2$ is provided along almost all the sides of the door 2 as shown in FIG. 12B. The projection $14_2$ of FIG. 12A improves the absorbing operation of the elongated portion 14′ of the cover means 14 of FIG. 10B.

Figure 13A:
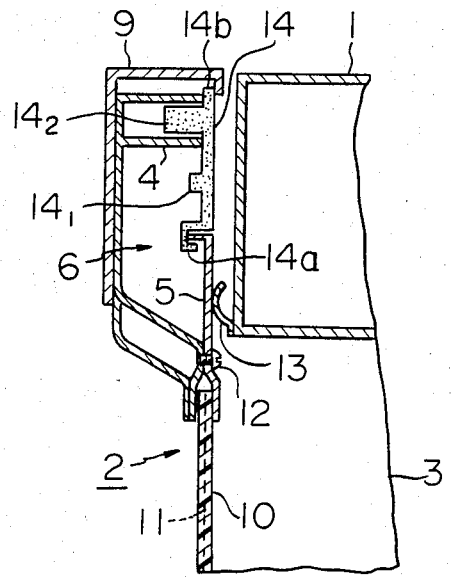
Figure 13B:
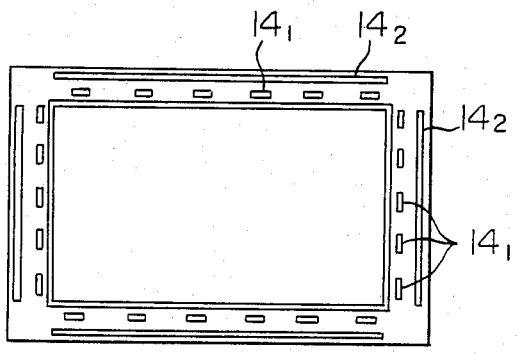
Figure 14A:
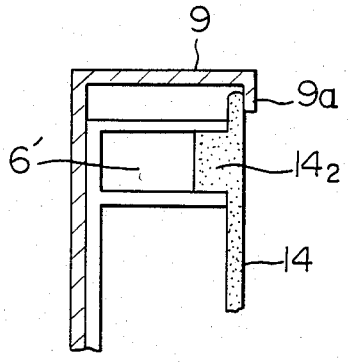
Figure 14B:
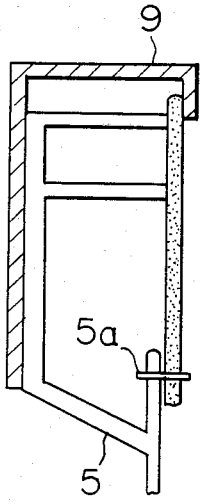
Figure 14C:
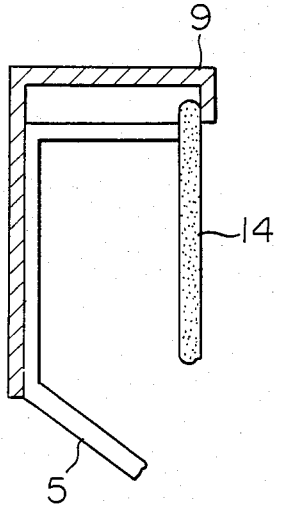
Figure 14D:
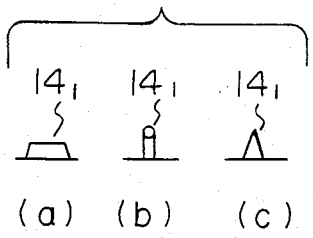

FIGS. 13A and 13B show still another modification of the present invention, and the feature of a embodiment of FIGS. 13A and 13B is the presence of both the projections $14_1$ of the embodiment of FIGS. 11A and 11B, and the second projections $14_2$ of the embodiment of FIGS. 12A and 12B. Of course, those projections $14_1$ and $14_2$ are integral with the cover means $14_1$ and are made of the same material as that of the cover means 14. Since the embodiment of FIGS. 13A and 13B has both the projections $14_1$ and $14_2$, it has both the effect of that of the embodiment of FIGS. 11A and 11B, and that of the embodiment of FIGS. 12A and 12B.

In the above embodiments, the cover means 14 and the projections $14_1$ and/or $14_2$ may be either a single bulk which encloses the peripheral of the door, or separated to a plurality of pieces which enclose the peripheral of the door.

Some modifications of the above embodiments are possible to those skilled in the art. FIG. 14(*a*) shows the arrangement to fix or support the cover means 14 by the end 9*a* of the decorative cover 9. When the cover means 14 has the elongated projection $14_2$, the cover means 14 is also supported by fixing the projection $14_2$ by the pair of walls of the room 6′.

FIG. 14(*b*) shows the embodiment, in which the conductive wall 5 has a pin 5*a* with a snap action, and the cover means 14 has a hole to accept that pin 5*a*, and the cover means 14 is supported by said pin and hole. Alternatively, the cover means may have a pin with a snap action, and the wall 5 may have a hole for accepting the pin.

FIG. 14(*c*) is the embodiment which has no additional room 6′. It should be appreciated that the embodiments of FIGS. 10A and 10B, and FIGS. 11A and 11B do not need that additional room 6′.

FIG. 14(*d*) shows three examples of the projection $14_1$ in the embodiments of FIGS. 11A and 11B, and FIGS. 13A and 13B. The cross section of the projection $14_1$ is trapezoidal (FIG. 14(*d*)-*a*), or triangular (FIG. 14(*d*)-*c*), or the projection $14_1$ may be a circular post (FIG. 14(*d*)-*b*).

The material of the cover means 14 may be either a mixture of ferrite and gum, or the mixture of ferrite and plastic.

The cover means 14 is provided on four sides of the door. The four cover means may be integral, or those four cover means may be separated, and each cover means for each side may be fixed to the side.

Figure 15A:
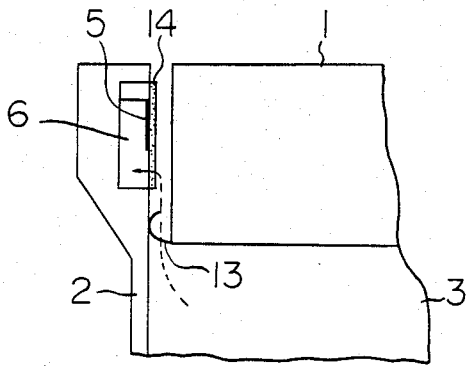
FIGS. 15A, 15B and 15C show some alternatives of the arrangement of a choke cavity according to the present invention.
Figure 15B:
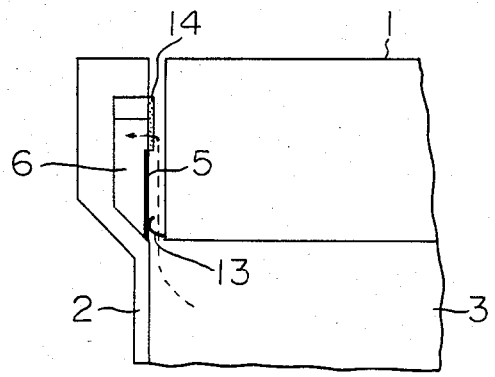
Figure 15C:
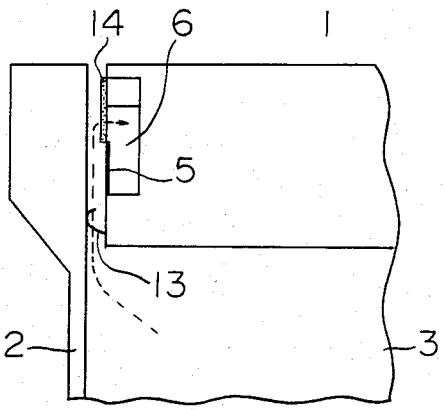

FIGS. 15A, 15B and 15C show some embodiments of the positioning of a choke cavity 6. In the arrangement of FIG. 15A, the choke cavity 6 is mounted on the door 2 so that the entrance of the cavity 6 is positioned upstream along the leakage path. The embodiment of FIG. 15B shows that the entrance of the cavity 6 is positioned downstream along the leakage path, and the previous embodiments of FIGS. 10A through 13B take the arrangement of FIG. 15B. On the other hand, in the embodiment of FIG. 15C, the cavity 6 is positioned on the main body, instead of the door. Those alternatives of the positioning of the cavity is a design matter to those skilled in the art.

As described above, the present invention has the feature that the cover means of the choke cavity is made of ferro-magnetic material, which also doubles as a dust cover. Because of the use of that magnetic material for the cover means, the present wave absorber is excellent in attenuating electro-magnetic energy without complicating the structure of the choke cavity. Further, the number of components for manufacturing the wave absorber may be decreased by the use of the integral cover means having a projection.

From the foregoing, it will now be apparent that a new and improved wave absorber device has been set forth. It should be understood of course that the embodiments disclosed are merely illustrative and are not intended to limit the scope of the invention. Reference should be made to the appended claims, therefore, rather than the specification as indicating the scope of the invention.

What is claimed is:

1. A microwave apparatus, comprising:

a main body with an opening;

a door coupled with the main body for closing said opening such that a leakage path exists at the interface between the periphery of the opening and the door;

a wave absorber device disposed adjacent said leakage path, said wave absorber device including an empty choke cavity having a length of approximately a quarter wavelength, said choke cavity being closed on at least three sides and having an entrance facing said leakage path;

a cover means comprising a flat plate closing said entrance, said cover means being formed of a mixture of ferro-magnetic material and dielectric material, said mixture having a dielectric constant less than 15.

2. Apparatus according to claim 1, wherein the value of tan $\delta_\mu$ which is the ratio of the imaginary part of complex permeability of the material of the cover means to the real part of the same, is larger than 0.5.

3. Apparatus according to claim 1, wherein said cover means extends beyond the entrance of the choke cavity along the leakage path.

4. Apparatus according to claim 1, wherein the flat plate of the cover means has a projection external to said choke cavity to absorb waves, said projection being integral with said flat plate.

5. Apparatus according to claim 1, wherein the material of said cover means is mixture of Ni-Mg-Zn ferrite and plastic.

6. Apparatus according to claim 1, wherein the material of said cover means is mixture of Mn-Zn ferrite and plastic.

7. Apparatus according to claim 1, wherein the thickness of the flat plate is approximately 2.5 mm.

8. Apparatus according to claim 1, wherein a conductive resilient means is provided across the leakage path to provide electrical contact between the main body and the door.

9. Apparatus according to claim 1, wherein said wave absorber device is mounted in said door.

10. Apparatus according to claim 1, wherein said wave absorber device is mounted in said main body.

11. Apparatus according to claim 1 wherein said choke cavity is of a generally rectangular shape, with the length dimension thereof parallel to said leakage path.

12. Apparatus as defined by claim 11 wherein said choke cavity is closed along a portion of a side thereof facing said leakage path, and said entrance comprises the remaining portion of said side facing said leakage path.

13. A microwave apparatus, comprising:

a main body with an opening;

a door coupled with the main body for closing said opening such that a leakage path exists at the interface between the periphery of the opening and the door;

a wave absorber device disposed adjacent said leakage path, said wave absorber device including a choke cavity having a length of approximately a quarter wavelength, said choke cavity being closed on at least three sides and having an entrance facing said leakage path;

a cover means comprising a flat plate closing said entrance and a projection integral with said plate projected into said choke cavity to an extent no greater than about 2.5 mm, the remainder of said choke cavity being empty, said cover means being formed of a mixture of ferro-magnetic material and dielectric material, said mixture having a dielectric constant less than 15.

14. Apparatus according to claim 13, wherein the value of tan $\delta_\mu$ which is the ratio of the imaginary part of complex permeability of the material of the cover means to the real part of the same, is larger than 0.5.

15. Apparatus according to claim 13, wherein said cover means extends beyond the entrance of the choke cavity along the leakage path.

16. Apparatus according to claim 13, wherein the flat plate of said cover means has a second projection projected external to said choke cavity.

17. Apparatus according to claim 13, wherein said projection is in trapezoidal shape.

18. Apparatus according to claim 13, wherein said projection is in triangular shape.

19. Apparatus according to claim 13, wherein said projection is in a circular post shape.

20. Apparatus according to claim 13, wherein said choke cavity is of a generally rectangular shape, with the length dimension thereof parallel to said leakage path.

21. Apparatus as defined by claim 20 wherein said choke cavity is closed along a portion of a side thereof facing said leakage path, and said entrance comprises the remaining portion of said side facing said leakage path.

* * * * *